US009135906B2

(12) United States Patent
Mitani et al.

(10) Patent No.: US 9,135,906 B2
(45) Date of Patent: Sep. 15, 2015

(54) ULTRASONIC GENERATOR

(71) Applicant: Murata Manufacturing Co., Ltd., Nagaokakyo-shi, Kyoto-Fu (JP)

(72) Inventors: Akihiro Mitani, Nagaokakyo (JP); Hironari Yamamoto, Nagaokakyo (JP)

(73) Assignee: MURATA MANUFACTING CO., LTD., Nagaokakyo-Shi, Kyoto-Fu (JP)

( * ) Notice: Subject to any disclaimer, the term of this patent is extended or adjusted under 35 U.S.C. 154(b) by 446 days.

(21) Appl. No.: 13/753,698

(22) Filed: Jan. 30, 2013

(65) Prior Publication Data

US 2013/0140956 A1 Jun. 6, 2013

Related U.S. Application Data

(63) Continuation of application No. PCT/JP2011/068095, filed on Aug. 9, 2011.

(30) Foreign Application Priority Data

Aug. 24, 2010 (JP) ..... 2010-187361

(51) Int. Cl.
*G10K 9/122* (2006.01)
*B06B 1/06* (2006.01)

(52) U.S. Cl.
CPC ..... *G10K 9/122* (2013.01); *B06B 1/0618* (2013.01)

(58) Field of Classification Search
CPC ..... G10K 9/122; B06B 1/0618
USPC ..... 310/334, 344
See application file for complete search history.

(56) References Cited

U.S. PATENT DOCUMENTS 5,105,116 A * 4/1992 Okamoto et al. ..... 310/311
6,543,109 B1 4/2003 Taga (Continued)

FOREIGN PATENT DOCUMENTS

CN 1265538 A 9/2000
JP 05-219588 A 8/1993

(Continued)

OTHER PUBLICATIONS

Japanese Office Action for corresponding application JP 2012-530617, dispatch date Oct. 29, 2013 (with English translation).

(Continued)

*Primary Examiner* — Derek Rosenau
*Assistant Examiner* — Bryan Gordon
(74) *Attorney, Agent, or Firm* — Arent Fox LLP

(57) ABSTRACT

An ultrasonic generator that includes an ultrasonic generating element and a first acoustic path. The ultrasonic generating element includes a frame including a through hole in its central portion, a first transducer being flat-shaped and bonded to a first principal surface of the frame, and a second transducer being flat-shaped and bonded to a second principal surface of the frame and is configured to generate ultrasonic waves in a buckling tuning-fork vibration mode where the first transducer and the second transducer vibrate in mutually opposite phases. The first acoustic path is disposed so as to be adjacent to at least one of both principal surfaces of the ultrasonic generating element and configured to compress the ultrasonic waves generated from the ultrasonic generating element and to allow the ultrasonic waves to propagate therethrough in a direction along the principal surface of the ultrasonic generating element.

19 Claims, 6 Drawing Sheets

(56) References Cited

U.S. PATENT DOCUMENTS

| | | | | |
|---|---|---|---|---|
| 7,162,930 | B2 * | 1/2007 | Hashimoto et al. | 73/861.25 |
| 8,009,846 | B2 * | 8/2011 | Sekino et al. | 381/191 |
| 2006/0223185 | A1 * | 10/2006 | Fedorov et al. | 435/461 |
| 2010/0246863 | A1 * | 9/2010 | Onishi et al. | 381/190 |

FOREIGN PATENT DOCUMENTS

| | | | |
|---|---|---|---|
| JP | 05-344582 | A | 12/1993 |
| JP | 2002-112391 | A | 4/2002 |
| JP | 2004-297219 | A | 10/2004 |
| JP | 2006-005845 | A | 1/2006 |
| WO | WO 2004/098234 | A1 | 11/2004 |

OTHER PUBLICATIONS

PCT/JP2011/068095 Written Opinion dated Sep. 29, 2011.

* cited by examiner (A)

(B)

ULTRASONIC GENERATOR

CROSS REFERENCE TO RELATED APPLICATIONS

The present application is a continuation of International application No. PCT/JP2011/068095, filed Aug. 9, 2011, which claims priority to Japanese Patent Application No. 2010-187361, filed Aug. 24, 2010, the entire contents of each of which are incorporated herein by reference.

FIELD OF THE INVENTION

The present invention relates to ultrasonic generators for generating ultrasonic waves and, more specifically, to an ultrasonic generator capable of outputting ultrasonic waves having a high sound pressure.

BACKGROUND OF THE INVENTION

Recently, a distance measuring method with ultrasonic waves has been used as an accurate distance measuring method. The method is generating ultrasonic waves from an ultrasonic generator, causing the ultrasonic waves to impinge on an object, detecting ultrasonic waves reflected from the object by ultrasonic microphone, and calculating the distance to the object from the time elapsed between the generation and the detection.

For example, Patent Document 1 discloses an ultrasonic generator in which piezoelectric transducers are attached to a housing. The ultrasonic generator disclosed in Patent Document 1 is configured as an ultrasonic sensor in which a single device serves as both an ultrasonic generator and an ultrasonic microphone. The ultrasonic generator includes, in addition to a first piezoelectric transducer for generating ultrasonic waves, a second piezoelectric transducer vibrating in opposite phase to that of the first piezoelectric transducer with the aim of cancelling unnecessary vibration.

FIG. 8 illustrates an ultrasonic generator (ultrasonic sensor) 500 disclosed in Patent Document 1. The ultrasonic generator 500 has a structure in which a first piezoelectric transducer 102 and a second piezoelectric transducer 103 for cancelling unnecessary vibration, the second piezoelectric transducer 103 vibrating in opposite phase to that of the first piezoelectric transducer 102, are attached to a housing 101. Each of the housing 101, first piezoelectric transducer 102, and second piezoelectric transducer 103 is connected to a lead 104. The space within the housing 101 is filled with a flexible filler 105.

Patent Document 1: Japanese Unexamined Patent Application Publication No. 2004-297219

SUMMARY OF THE INVENTION

To make a result of measurement more accurate and lengthen a measurable distance in the above-described distance measuring method, it is useful to increase an output sound pressure of the ultrasonic generator.

However, for example, increasing the output sound pressure in the known ultrasonic generator 500 described above is limited. That is, although increasing the output sound pressure requires that the polarization of the piezoelectric transducer be increased or the electric power supplied to the piezoelectric transducer be enlarged, the polarization of the piezoelectric transducer is limited and, because too large supplied electric power causes the piezoelectric transducer to exceed its breakdown limit, increasing the output sound pressure is limited.

The need for miniaturization of electronic devices and apparatuses has been strong in recent years. If the piezoelectric transducer is miniaturized to reduce the size of the ultrasonic generator, a problem arises in that the output sound pressure reduces. Accordingly, there also is a problem that the miniaturization of the ultrasonic generator is difficult.

The present invention is made to solve the above-described problems in the known ultrasonic generator. As its means, an ultrasonic generator according to the present invention includes an ultrasonic generating element and a first acoustic path. The ultrasonic generating element includes a frame including at least one of a groove and a through hole in a central portion thereof, a first transducer being flat-shaped and bonded to a first principal surface of the frame, and a second transducer being flat-shaped and bonded to a second principal surface of the frame. The ultrasonic generating element is configured to generate ultrasonic waves in a buckling tuning-fork vibration mode where the first transducer and the second transducer vibrate in mutually opposite phases. The first acoustic path is disposed so as to be adjacent to at least one of both principal surfaces of the ultrasonic generating element and configured to compress the ultrasonic waves generated from the ultrasonic generating element and to allow the ultrasonic waves to propagate therethrough in a direction along the principal surface of the ultrasonic generating element.

The ultrasonic generator having the above-described configuration according to the present invention can provide ultrasonic waves being in phase and having a high sound pressure and can achieve an increased output sound pressure. Accordingly, when the ultrasonic generator according to the present invention is used in distance measurement, a more accurate result of the measurement and a longer measurable distance can be achieved.

Even when the transducer is miniaturized and, in addition, the ultrasonic generator is miniaturized, a high output sound pressure can be maintained. According to the present invention, the miniaturization of the ultrasonic generator can be achieved.

The first acoustic path may be disposed so as to be adjacent to one side of the ultrasonic generating element or each of both sides of the ultrasonic generating element. In the case where the first acoustic path is disposed so as to be adjacent to each of both sides thereof, ultrasonic waves from the first principal surface of the ultrasonic generating element and those from the second principal surface thereof can be combined and output. In this case, the output sound pressure can be further increased.

DETAILED DESCRIPTION OF THE PREFERRED EMBODIMENTS

Embodiments for carrying out the present invention are described below with reference to the drawings.

First Embodiment

Figure 1:
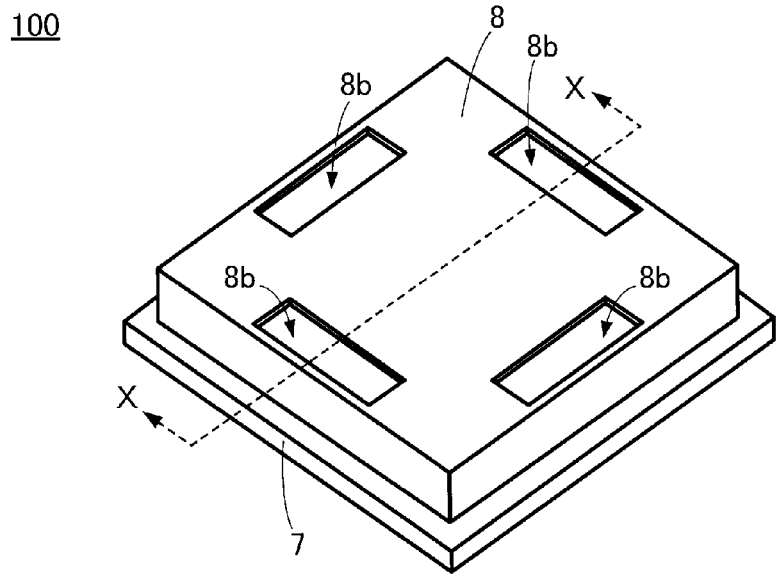
FIG. 1 is a perspective view that illustrates an ultrasonic generator 100 according to a first embodiment of the present invention.
Figure 2:
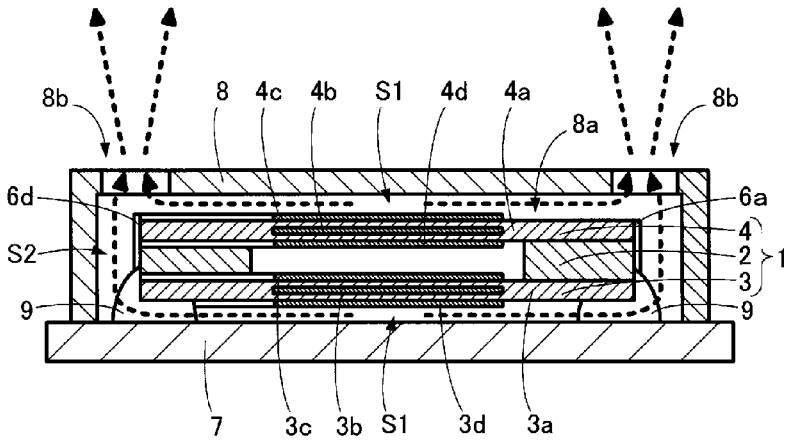
FIG. 2 is a cross-sectional view that illustrates the ultrasonic generator 100 according to the first embodiment of the present invention and illustrates a portion taken along the dashed line X-X in FIG. 1.
Figure 3:
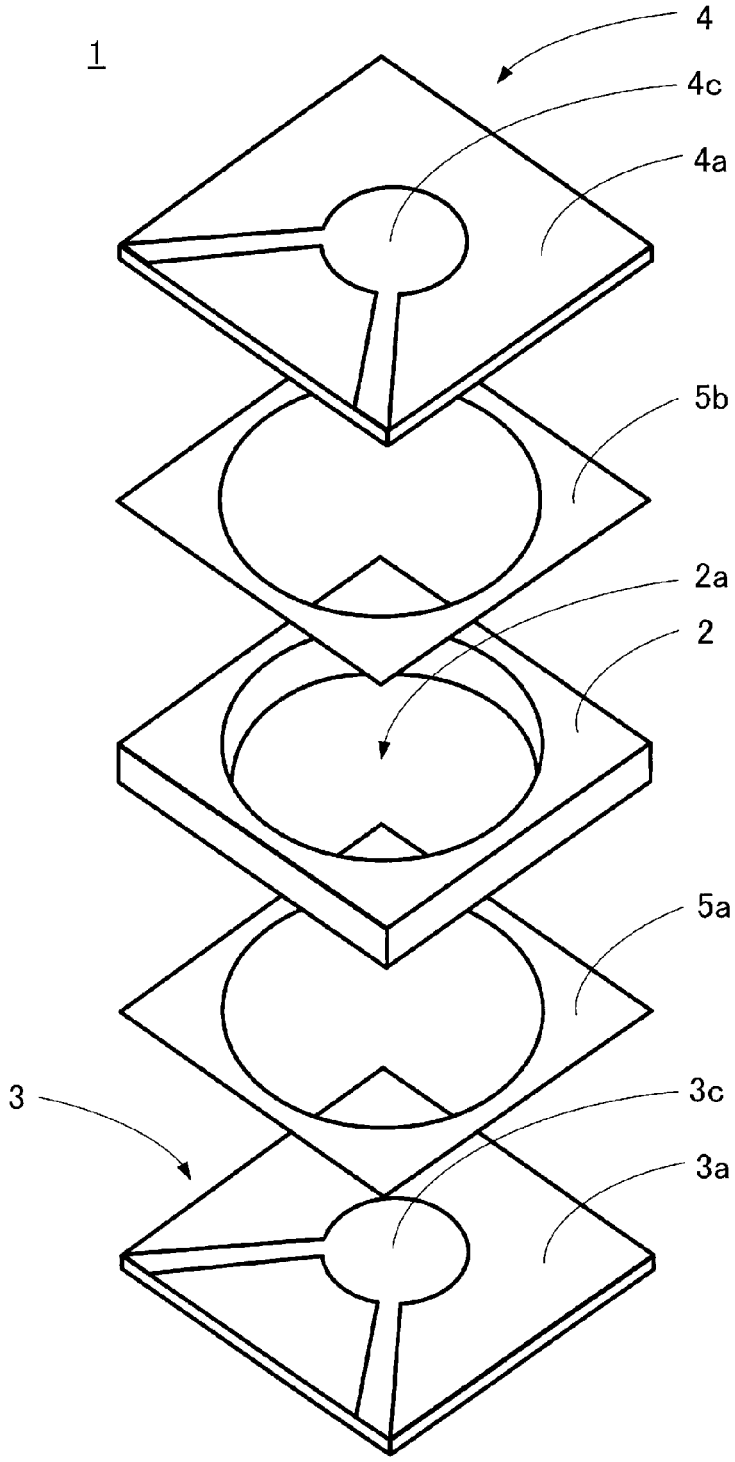
FIG. 3 is an exploded perspective view that illustrates an ultrasonic generating element 1 used in the ultrasonic generator 100 according to the first embodiment of the present invention.

FIGS. 1 and 2 illustrate an ultrasonic generator 100 according to a first embodiment of the present invention. FIG. 1 is a perspective view, and FIG. 2 is a cross-sectional view that illustrates a portion taken along the dashed line X-X in FIG. 1. FIG. 3 illustrate an ultrasonic generating element 1 used in the ultrasonic generator 100. FIG. 3 is an exploded perspective view.

The ultrasonic generator 100 includes the ultrasonic generating element 1.

The ultrasonic generating element 1 includes a frame 2, a first bimorph piezoelectric transducer 3, and a second bimorph piezoelectric transducer 4. The frame 2 has a through hole 2*a* in its central portion. The first bimorph piezoelectric transducer 3 is bonded to the lower principal surface of the frame 2 with an adhesive 5*a*. The second bimorph piezoelectric transducer 4 is bonded to the upper principal surface of the frame 2 with an adhesive 5*b*. That is, the frame 2 has a structure in which the through hole 2*a* is covered with the first bimorph piezoelectric transducer 3 and the second bimorph piezoelectric transducer 4. The ultrasonic generating element 1 can have a thickness of approximately 320 μm, for example.

The frame 2 can be made of ceramic and have a thickness of approximately 200 μm, for example. The through hole 2*a* can have a diameter of approximately 2.4 mm, for example. The frame 2 may have a groove in its central portion, instead of the through hole 2*a*. That is, the frame 2 is not limited to a structure of a closed ring shape and may be a structure of a partly opened ring shape.

The first bimorph piezoelectric transducer 3 includes a flat-shaped rectangular piezoelectric ceramics 3*a* made of, for example, lead zirconate titanate (PZT). An internal electrode 3*b* is disposed inside the piezoelectric ceramics 3*a*. External electrodes 3*c* and 3*d* are disposed on both principal surfaces of the piezoelectric ceramics 3*a*, respectively. Each of the internal electrode 3*b* and the external electrodes 3*c* and 3*d* can be an excitation electrode made of, for example, silver or palladium. The internal electrode 3*b* is extended to two neighboring corners of the piezoelectric ceramics 3*a*. In contrast, each of the external electrodes 3*c* and 3*d* is extended to two neighboring corners to which the internal electrode 3*b* is not extended of the piezoelectric ceramics 3*a*, respectively. The first bimorph piezoelectric transducer 3 can have a thickness of approximately 60 μm, for example.

The second bimorph piezoelectric transducer 4 includes flat-shaped rectangular piezoelectric ceramics 4*a* made of, for example, PZT, similar to the first bimorph piezoelectric transducer 3. An internal electrode 4*b* is disposed inside the piezoelectric ceramics 4*a*. External electrodes 4*c* and 4*d* are disposed on both principal surfaces of the piezoelectric ceramics 4*a*, respectively. Each of the internal electrode 4*b* and the external electrodes 4*c* and 4*d* can also be an excitation electrode made of, for example, silver or palladium. The internal electrode 4*b* is extended to two neighboring corners of the piezoelectric ceramics 4*a*. Each of the external electrodes 4*c* and 4*d* is extended to two neighboring corners to which the internal electrode 4*b* is not extended of the piezoelectric ceramics 4*a*, respectively. The second bimorph piezoelectric transducer 4 can also have a thickness of approximately 60 μm, for example.

Each of the piezoelectric ceramics 3*a* of the first bimorph piezoelectric transducer 3 and the piezoelectric ceramics 4*a* of the second bimorph piezoelectric transducer 4 is polarized inside. The direction of polarization between the external electrode 3*c* and the internal electrode 3*b* and that between the internal electrode 3*b* and the external electrode 3*d* in the piezoelectric ceramics 3*a* are the same. Similarly, the direction of polarization between the external electrode 4*c* and the internal electrode 4*b* and that between the internal electrode 4*b* and the external electrode 4*d* in the piezoelectric ceramics 4*a* are the same. In contrast, the direction of polarization between the piezoelectric ceramics 3*a* and the internal electrode 3*b* and that between the internal electrode 3*b* and the external electrode 3*d* in the piezoelectric ceramics 3*a* is opposite to the direction of polarization between the external electrode 4*c* and the internal electrode 4*b* and that between the internal electrode 4*b* and the external electrode 4*d* in the piezoelectric ceramics 4*a*.

Extended electrodes 6*a*, 6*b*, 6*c*, and 6*d* are disposed on four corners of the ultrasonic generating element 1, respectively. Each of the two neighboring extended electrodes 6*a* and 6*b* is electrically connected to the internal electrode 3*b* in the piezoelectric ceramics 3*a* and the internal electrode 4*b* in the piezoelectric ceramics 4*a*. Each of the remaining two neighboring extended electrodes 6*c* and 6*d* is electrically connected to the external electrodes 3*c* and 3*d* on the piezoelectric ceramics 3*a* and the external electrodes 4*c* and 4*d* on the piezoelectric ceramics 4*a*. (The extended electrodes 6*a* and 6*d* are illustrated in FIG. 2, and representation of the extended electrodes 6*b* and 6*c* is omitted and the extended electrodes 6*b* and 6*c* are not illustrated in any drawings.) The extended electrodes 6*a*, 6*b*, 6*c*, and 6*d* can be made of silver, for example.

The ultrasonic generator 100 further includes a housing including a substrate 7 and a cover member 8.

The substrate 7 can be made of, for example, glass epoxy and is rectangular and flat-shaped. A plurality of land electrodes (not illustrated) is disposed on the upper principal surface of the substrate 7. The ultrasonic generating element 1 is mounted on the substrate 7 by bonding of the extended electrodes 6*a*, 6*b*, 6*c*, and 6*d* in the ultrasonic generating element 1 to the land electrodes with a conductive adhesive 9. A gap defined by the substrate 7 and the ultrasonic generating element 1 (first bimorph piezoelectric transducer 3) forms a first acoustic path S1, compresses ultrasonic waves generated from the first bimorph piezoelectric transducer 3, and contributes to propagation of the ultrasonic waves along the lower principal surface of the ultrasonic generating element 1. That is, the substrate 7 is an acoustic path member. The length of the gap (first acoustic path S1) defined by the substrate 7 and the ultrasonic generating element 1 is set at 30 μm or more and, in particular, at 100 to 200 μm to make ultrasonic waves generated from the first bimorph piezoelectric transducer 3 be in phase and to increase the sound pressure. Because the ultrasonic generating element 1 is bonded to the substrate 7 at the four corners with the conductive adhesive 9, propagation of the ultrasonic waves generated from the ultrasonic generating element 1 is not inhibited.

The cover member 8 can be made of, for example, nickel silver, and includes an opening 8*a* for housing the ultrasonic generating element 1 and rectangular acoustic outlets 8*b* in its top plate portion. The cover member 8 can include any number of acoustic outlets 8*b*, although the cover member 8 includes four acoustic outlets 8*b* in the present embodiment. The ultrasonic generating element 1 is housed in the opening 8*a* of the cover member 8, and the edge defining the opening 8*a* is bonded to the upper principal surface of the substrate 7 with, for example, an adhesive (not illustrated). A gap defined by the cover member 8 and the ultrasonic generating element 1 (second bimorph piezoelectric transducer 4) forms the first acoustic path S1, compresses ultrasonic waves generated from the second bimorph piezoelectric transducer 4, and contributes to propagation of the ultrasonic waves along the upper principal surface of the ultrasonic generating element 1. That is, the cover member 8 is the acoustic path member. The length of the gap (first acoustic path S1) defined by the cover member 8 and the ultrasonic generating element 1 is set at 30 μm or more and, in particular, at 100 to 200 μm to make ultrasonic waves generated from the second bimorph piezoelectric transducer 4 be in phase and to increase the sound pressure.

A gap defined by the outer surface of the ultrasonic generating element 1 and the inner surface of the housing including the substrate 7 and the cover member 8 in the ultrasonic generator 100 forms a second acoustic path S2. A part of the second acoustic path S2 forms the above-described first acoustic path S1 in the vicinity of the antinode of vibration of the first bimorph piezoelectric transducer 3 and in the vicinity of the antinode of vibration of the second bimorph piezoelectric transducer 4. The first acoustic path S1 compresses ultrasonic waves generated from the first bimorph piezoelectric transducer 3 or the second bimorph piezoelectric transducer 4 and contributes to propagation of the ultrasonic waves along the principal surface of the ultrasonic generating element 1.

The ultrasonic generator 100 having the above-described structure can be manufactured by a method described below, for example.

First, the first bimorph piezoelectric transducer 3 and the second bimorph piezoelectric transducer 4 are produced. Specifically, a plurality of piezoelectric ceramic green sheets each having a predetermined shape is prepared, and conductive paste for forming the internal electrodes 3*b* and 4*b* and the external electrodes 3*c*, 3*d*, 4*c*, and 4*d* is printed on the surfaces of the piezoelectric ceramic green sheets so as to have a predetermined shape. Then, the predetermined piezoelectric ceramic green sheets are stacked, pressed, and then fired at a predetermined profile, and the first bimorph piezoelectric transducer 3 with the internal electrode 3*b* and the external electrodes 3*c* and 3*d* and the second bimorph piezoelectric transducer 4 with the internal electrode 4*b* and the external electrodes 4*c* and 4*d* are obtained. The external electrodes 3*c*, 3*d*, 4*c*, and 4*d* may be formed by printing or sputtering after the stacked piezoelectric ceramic green sheets are fired.

Then, the frame 2 previously produced so as to have a predetermined shape is prepared. The first bimorph piezoelectric transducer 3 and the second bimorph piezoelectric transducer 4 are bonded to both principal surfaces of the frame 2, respectively, using the adhesives 5*a* and 5*b*, and the ultrasonic generating element 1 is obtained.

Then, the extended electrodes 6*a*, 6*b*, 6*c*, and 6*d* are formed on the four corners of the ultrasonic generating element 1 using a technique, such as sputtering.

Then, the substrate 7 and the cover member 8 each previously produced so as to have a predetermined shape are prepared. The ultrasonic generating element 1 is mounted on the substrate 7 using the conductive adhesive 9. The cover member 8 is bonded to the upper principal surface of the substrate 7 using an adhesive (not illustrated). The ultrasonic generator 100 is completed.

Figure 4:
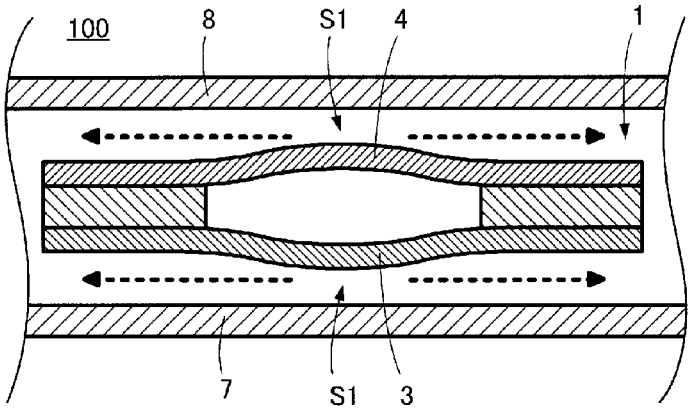
FIG. 4 includes illustrations for describing a driving state of the ultrasonic generator 100 according to the first embodiment of the present invention.
Figure 4:
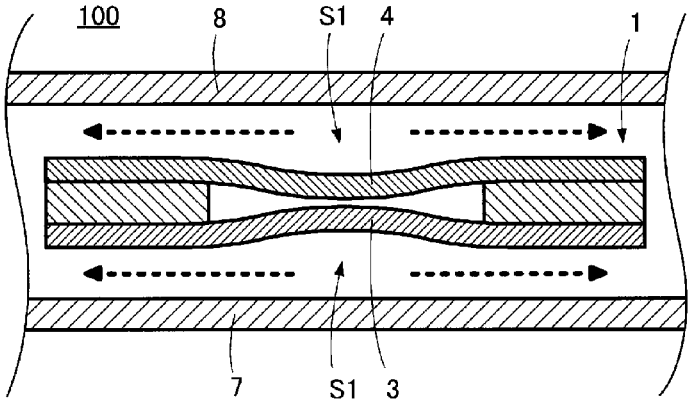

Next, a driving state of the ultrasonic generator 100 is described below. FIGS. 4(A) and 4(B) illustrate states where an alternating current having a predetermined frequency is applied to the ultrasonic generating element 1 in the ultrasonic generator 100.

Because the first bimorph piezoelectric transducer 3 and the second bimorph piezoelectric transducer 4 in the ultrasonic generating element 1 includes the internal electrode 3*b* and the external electrodes 3*c* and 3*d* and the internal electrode 4*b* and the external electrodes 4*c* and 4*d*, as described above, and they are polarized, as described above, application of an alternating current thereto makes them vibrate in mutually opposite phases with the same frequency, and the states illustrated in FIGS. 4(A) and 4(B) repeat. That is, the ultrasonic generating element 1 vibrates in a buckling tuning-fork vibration mode, and each of the first bimorph piezoelectric transducer 3 and the second bimorph piezoelectric transducer 4 generates ultrasonic waves.

The ultrasonic waves generated from the first bimorph piezoelectric transducer 3 are compressed in the vicinity of the antinode of vibration (location where the largest vibration occurs) of the first bimorph piezoelectric transducer 3 in the first acoustic path S1 formed from the gap defined by the first bimorph piezoelectric transducer 3 and the substrate (acoustic path member) 7, and they propagate in the directions along the lower principal surface of the ultrasonic generating element 1, as indicated by the arrows with the broken lines. The ultrasonic waves compressed in the first acoustic path S1 are in phase and have a high sound pressure.

The ultrasonic waves generated from the second bimorph piezoelectric transducer 4 are compressed in the vicinity of the antinode of vibration (location where the largest vibration occurs) of the second bimorph piezoelectric transducer 4 in the first acoustic path S1 formed from the gap defined by the second bimorph piezoelectric transducer 4 and the cover member (acoustic path member) 8, and they propagate in the directions along the upper principal surface of the ultrasonic generating element 1, as indicated by the arrows with the broken lines. The ultrasonic waves compressed in the first acoustic path S1 are in phase and have a high sound pressure.

The ultrasonic waves generated from the first bimorph piezoelectric transducer 3 and those from the second bimorph piezoelectric transducer 4 propagate through the second acoustic path S2 formed from the gap defined by the outer surface of the ultrasonic generating element 1 and the inner surface of the housing including the substrate 7 and the cover member 8 to the acoustic outlets 8*b* and are emitted through the acoustic outlets 8*b* to the outside, as indicated by the arrows with the broken lines in FIG. 2.

Before the ultrasonic waves generated from the first bimorph piezoelectric transducer 3 and those from the second bimorph piezoelectric transducer 4 propagate to the acoustic outlets 8*b* and are emitted through the acoustic outlets 8*b* to the outside, they are combined so as to increase the sound pressure. Thus, the output sound pressure is further increased.

Although the distance from where ultrasonic waves are generated from the first bimorph piezoelectric transducer 3 to where they arrive at one of the acoustic outlets 8*b* and that from where ultrasonic waves are generated from the second bimorph piezoelectric transducer 4 to where they arrive at the acoustic outlet 8*b* are different, the difference is as little as approximately 320 μm, which is the thickness of the ultrasonic generating element 1. Thus, it does not affect the advantageous effect of increasing the sound pressure. That is, ultrasonic waves generated from the ultrasonic generating element 1 can be of 60 kHz and of wavelength 5.7 mm, for example, whereas the difference in the distance is approximately 320 μm and no more than 0.06λ. Thus, it does not affect the advantageous effect of increasing the sound pressure.

The structure of, an example of the manufacturing method for, and the driving state of the ultrasonic generator 100 according to the first embodiment of the present invention are described above. However, the ultrasonic generator according to the present invention is not limited to the above-described description, and various changes can be made in accordance with the scope of the invention.

For example, the first acoustic path S1 is disposed so as to be adjacent to at least one of both principal surfaces of the ultrasonic generating element 1. Even in the case where the first acoustic path S1 is disposed so as to be adjacent to only one principal surface, generated ultrasonic waves are in phase and the sound pressure is increased.

The first and second transducers included in the ultrasonic generating element 1 may be transducers of other types, such as unimorph piezoelectric transducers and multimorph piezoelectric transducers, instead of the bimorph piezoelectric transducers 3 and 4. In the case where each of the first and second transducers included in the ultrasonic generating element 1 is a bimorph piezoelectric transducer or multimorph piezoelectric transducer, the transducer can be connected to the outside using an electrode on its end face, and there is no need to use bonding wire. Thus, a space for use in connecting bonding wire is not necessary, miniaturization can be achieved, the gap defined by the transducer and the acoustic path member can be reduced, ultrasonic waves generated from the transducer can be further compressed, and the sound pressure can be further increased. Because an electric field applied to the piezoelectric ceramics of the bimorph piezoelectric transducer or multimorph piezoelectric transducer is strong, the driving force is larger than that of a unimorph piezoelectric transducer. Thus, in the case where each of the first and second transducers included in the ultrasonic generating element 1 is the bimorph piezoelectric transducer or multimorph transducer, the sound pressure can be further increased.

Second Embodiment

Figure 5:
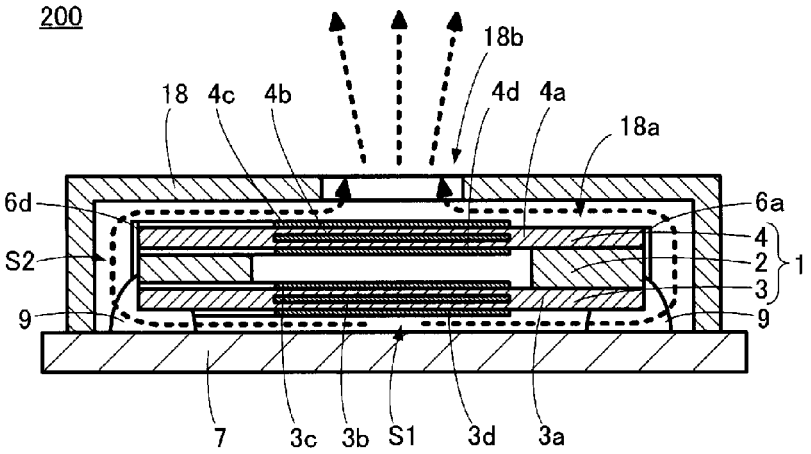
FIG. 5 is a cross-sectional view that illustrates an ultrasonic generator 200 according to a second embodiment of the present invention.

FIG. 5 illustrates an ultrasonic generator 200 according to a second embodiment of the present invention. FIG. 5 is a cross-sectional view.

Instead of the cover member 8 used in the above-described ultrasonic generator 100 according to the first embodiment, a cover member 18 is used in the ultrasonic generator 200. The other configuration is substantially the same as in the first embodiment.

The cover member 18 includes an opening 18*a* for housing the ultrasonic generating element 1 and a single acoustic outlet 18*b* in its top plate portion.

Because the number of acoustic outlets 18*b* in the ultrasonic generator 200 is one, the ultrasonic generator 200 can generate ultrasonic waves having a high sound pressure in a concentrated manner.

Third Embodiment

Figure 6:
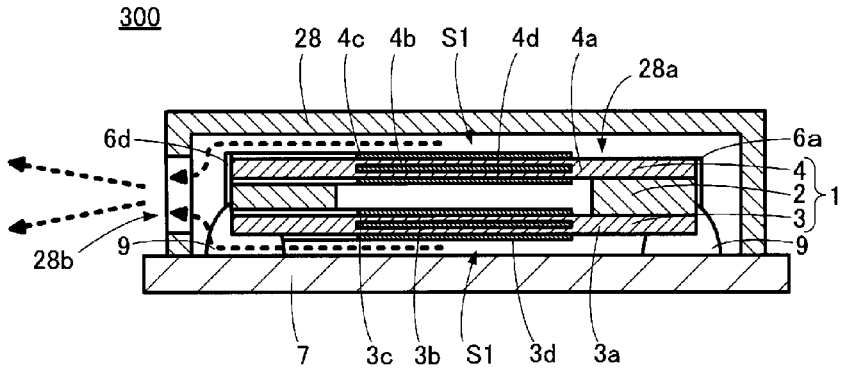
FIG. 6 is a cross-sectional view that illustrates an ultrasonic generator 300 according to a third embodiment of the present invention.

FIG. 6 illustrates an ultrasonic generator 300 according to a third embodiment of the present invention. FIG. 6 is a cross-sectional view.

Instead of the cover member 8 used in the above-described ultrasonic generator 100 according to the first embodiment, a cover member 28 is used in the ultrasonic generator 300. The other configuration is substantially the same as in the first embodiment.

The cover member 28 includes an opening 28*a* for housing the ultrasonic generating element 1 and a single acoustic outlet 28*b* in its side plate portion.

The distance from where ultrasonic waves are generated from the first bimorph piezoelectric transducer 3 to where they arrive at the acoustic outlet 28*b* and that from where ultrasonic waves are generated from the second bimorph piezoelectric transducer 4 to where they arrive at the acoustic outlet 28*b* in the ultrasonic generator 300 are the same. Thus, the ultrasonic waves from the two transducers can be efficiently combined, and the sound pressure can be increased. The cover member 28 may include a plurality of acoustic outlets 28*b* in its side plate portions. Preferably, they may be disposed in side surfaces of the cover member 28 that are opposed to each other. More preferably, they may be disposed in all side surfaces of the cover member 28.

Fourth Embodiment

Figure 7:
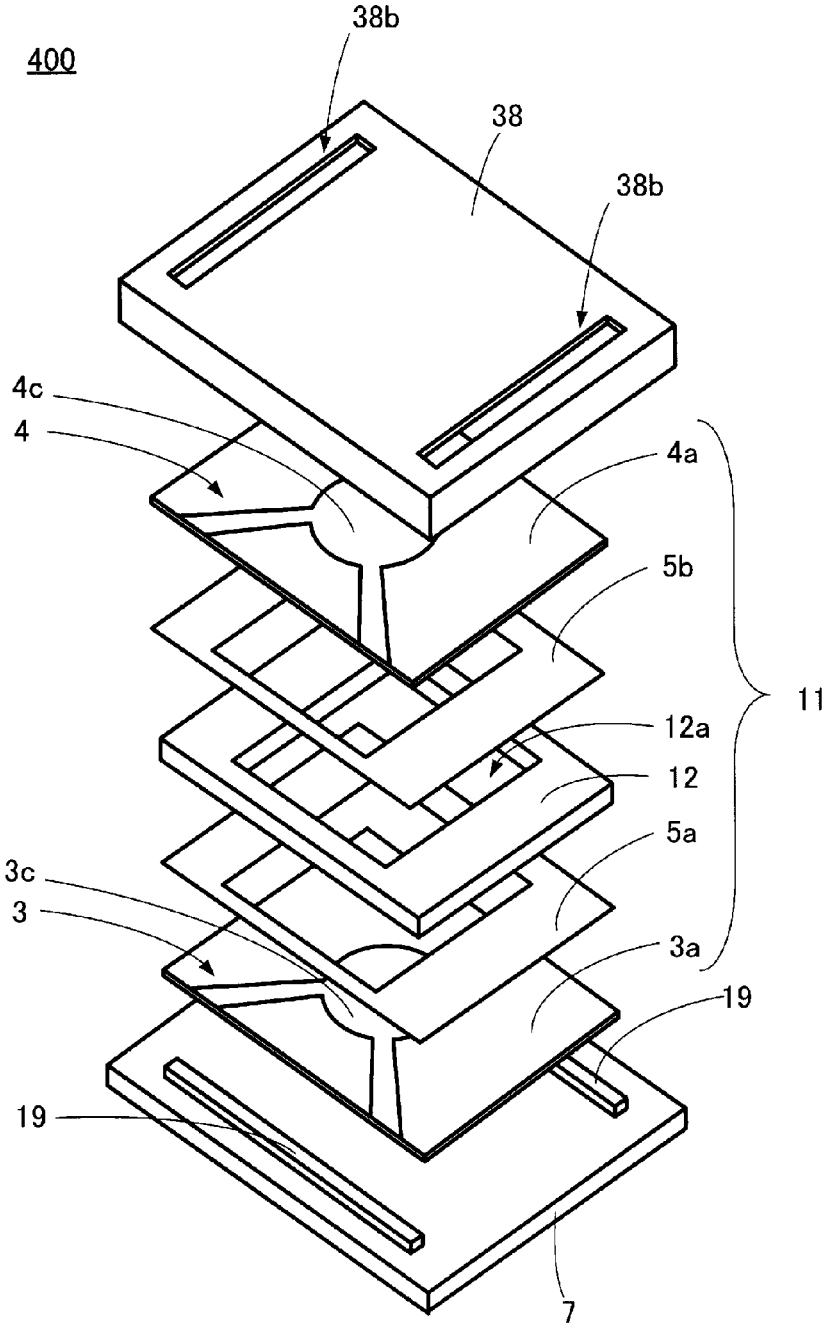
FIG. 7 is an exploded perspective view that illustrates an ultrasonic generator 400 according to a fourth embodiment of the present invention.
Figure 8:
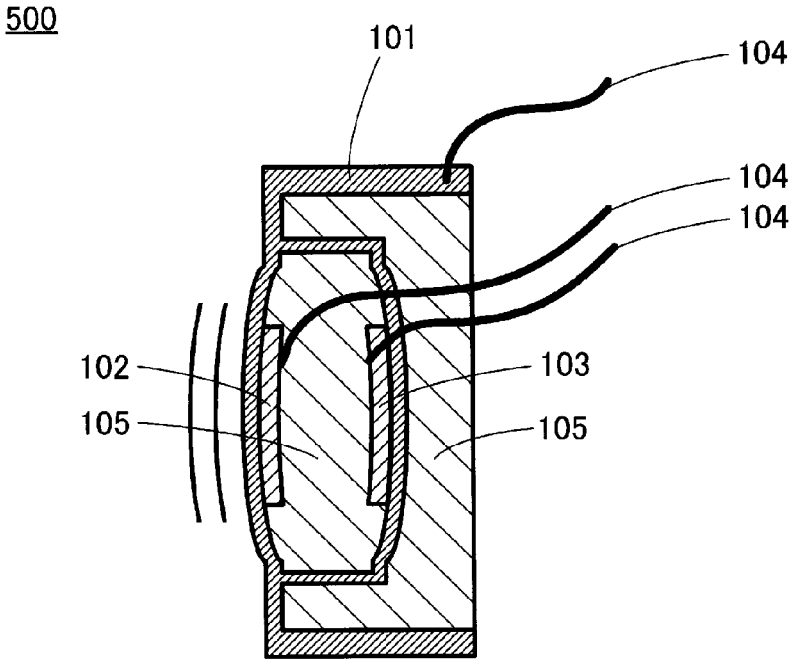
FIG. 8 PRIOR ART
FIG. 8 is a cross-sectional view that illustrates a known ultrasonic generator 500.

FIG. 7 illustrates an ultrasonic generator 400 according to a fourth embodiment of the present invention. FIG. 7 is an exploded perspective view.

The ultrasonic generator 400 is the one in which several changes are made on the above-described ultrasonic generator 100 according to the first embodiment. Instead of the ultrasonic generating element 1, cover member 8, and conductive adhesive 9 used in the above-described ultrasonic generator 100 according to the first embodiment, an ultrasonic generating element 11, a cover member 38, and conductive adhesives 19 are used in the ultrasonic generator 400.

First, a through hole 12*a* of a frame 12 in the ultrasonic generating element 11 is rectangular.

Additionally, the ultrasonic generating element 11 is bonded to the upper principal surface of the substrate 7 using the pair of conductive adhesives 19 linearly applied on the upper principal surface of the substrate 7 so as to correspond to two opposed sides of the ultrasonic generating element 11.

Moreover, the cover member 38 includes a pair of linear acoustic outlets 38*b* in its top surface. The linear acoustic outlets 38*b* are arranged in a direction perpendicular to the conductive adhesives 19 used in bonding the ultrasonic generating element 11 to the substrate 7.

The ultrasonic generator 400 having the above-described structure enables ultrasonic waves from the first bimorph piezoelectric transducer 3 and those from the second bimorph piezoelectric transducer 4 to efficiently propagate to the acoustic outlets 38*b*, be combined, and be emitted through the acoustic outlets 38*b* to the outside with a high sound pressure. The linearly applied conductive adhesives 19 do not inhibit propagation of the ultrasonic waves generated from the first bimorph piezoelectric transducer 3.

REFERENCE SIGNS LIST

1, 11: ultrasonic generator
2, 12: frame
3: first bimorph piezoelectric transducer
4: second bimorph piezoelectric transducer
3*b*, 4*b*: internal electrode
3*c*, 3*d*, 4*c*, 4*d*: external electrode
5*a*, 5*b*: adhesive
7: substrate
8, 18, 28, 38: cover member
8*a*, 18*a*, 28*a*, (38*a*): opening
8*b*, 18*b*, 28*b*, 38*b*: acoustic outlet
9, 19: conductive adhesive
S1: first acoustic path
S2: second acoustic path

The invention claimed is:

1. An ultrasonic generator comprising:

an ultrasonic generating element including a frame defining an opening therethrough in a central portion thereof, a first, flat-shaped transducer adjacent a first principal surface of the frame, and a second, flat-shaped transducer adjacent a second principal surface of the frame, the ultrasonic generating element being configured to generate ultrasonic waves in a buckling tuning-fork vibration mode when the first transducer and the second transducer vibrate in mutually opposite phases; and a first acoustic path adjacent to at least one of the first and second principal surfaces of the ultrasonic generating element and configured to compress the ultrasonic waves generated from the ultrasonic generating element and to allow the ultrasonic waves to propagate in a direction along the at least one of the first and second principal surfaces of the ultrasonic generating element.

2. The ultrasonic generator according to claim 1, wherein the first acoustic path is arranged in a vicinity of an antinode of vibration of the first or second transducer.

3. The ultrasonic generator according to claim 1, wherein the first acoustic path is a gap defined by the first or second transducer and an acoustic path member opposed to the transducer.

4. The ultrasonic generator according to claim 1, wherein the first acoustic path is adjacent to each of the first and second principal surfaces of the ultrasonic generating element.

5. The ultrasonic generator according to claim 1, wherein the ultrasonic generator is configured to combine first ultrasonic waves from a first surface of the ultrasonic generating element and second ultrasonic waves from a second surface of the ultrasonic generating element.

6. The ultrasonic generator according to claim 1, further comprising:

a housing including a substrate on which the ultrasonic generating element is mounted, a cover attached to the substrate so as to house the ultrasonic generating element between the cover and the substrate, and one or more acoustic outlets extending through the housing; and a second acoustic path defined by an outer surface of the ultrasonic generating element and an inner surface of the housing, wherein a part of the second acoustic path forms the first acoustic path.

7. The ultrasonic generator according to claim 6, wherein a difference between a distance of at least one of the first acoustic path and the second acoustic path from a first surface of the ultrasonic generating element to one of the acoustic outlets and a distance of at least one of the first acoustic path and the second acoustic path from a second surface of the ultrasonic generating element to the one of the acoustic outlets has a length where a first ultrasonic waves from the first surface of the ultrasonic generating element and a second ultrasonic waves from the second surface are combined such that a sound pressure thereof is increased.

8. The ultrasonic generator according to claim 6, wherein the one or more acoustic outlets extend through the cover.

9. The ultrasonic generator according to claim 5, further comprising:

a housing including a substrate on which the ultrasonic generating element is mounted, a cover attached to the substrate so as to house the ultrasonic generating element between the cover and the substrate, and one or more acoustic outlets extending through the housing; and a second acoustic path defined by an outer surface of the ultrasonic generating element and an inner surface of the housing, wherein a part of the second acoustic path forms the first acoustic path.

10. The ultrasonic generator according to claim 9, wherein a difference between a distance of at least one of the first acoustic path and the second acoustic path from the first surface of the ultrasonic generating element to one of the acoustic outlets and a distance of at least one of the first acoustic path and the second acoustic path from the second surface of the ultrasonic generating element to the one of the acoustic outlets has a length where the first ultrasonic waves from the first surface of the ultrasonic generating element and the second ultrasonic waves from the second surface are combined such that a sound pressure thereof is increased.

11. The ultrasonic generator according to claim 9, wherein the one or more acoustic outlets extend through the cover.

12. The ultrasonic generator according to claim 1, wherein the opening defined by the frame is a through hole.

13. The ultrasonic generator according to claim 12, wherein the through hole is circular.

14. The ultrasonic generator according to claim 12, wherein the through hole is rectangular.

15. An ultrasonic generator comprising:

an ultrasonic generating element including a frame, a first bimorph piezoelectric transducer adjacent a first surface of the frame, and a second bimorph piezoelectric transducer adjacent a second surface of the frame, the frame defining an opening therethrough in a central portion thereof, the first bimorph piezoelectric transducer including a first flat-shaped piezoelectric body on which a first excitation electrode is disposed, the second bimorph piezoelectric transducer including a second flat-shaped piezoelectric body on which a second excitation electrode is disposed, the ultrasonic generating element being configured to generate ultrasonic waves in a buckling tuning-fork vibration mode when the first bimorph piezoelectric transducer and the second bimorph piezoelectric transducer vibrate in mutually opposite phases;

a housing including a substrate on which the ultrasonic generating element is mounted with a conductive member disposed therebetween, a cover attached to the substrate so as to house the ultrasonic generating element between the cover and the substrate, and one or more acoustic outlets extending through the housing; and a first acoustic path defined by the first bimorph piezoelectric transducer and the substrate and defined by the second bimorph piezoelectric transducer and the cover, the first acoustic path being configured to compress the ultrasonic waves generated from the first or second bimorph piezoelectric transducer in a vicinity of an antinode of vibration of the first or second bimorph piezoelectric transducer and to allow the ultrasonic waves to propagate in a direction along first or second surfaces of the ultrasonic generating element.

16. The ultrasonic generator according to claim 15, wherein the opening defined by the frame is a through hole.

17. The ultrasonic generator according to claim 16, wherein the through hole is circular.

18. The ultrasonic generator according to claim 16, wherein the through hole is rectangular.

19. An ultrasonic generator comprising:

an ultrasonic generating element including a frame defining an opening therethrough in a central portion thereof, a first, flat-shaped transducer adjacent a first surface of the frame, and a second, flat-shaped transducer adjacent a second surface of the frame, the ultrasonic generating element being configured to generate ultrasonic waves in a buckling tuning-fork vibration mode when the first transducer and the second transducer vibrate in mutually opposite phases, wherein each of the first transducer and the second transducer is a multimorph piezoelectric transducer.

* * * * *